US008038260B2

(12) United States Patent
Okamura

(10) Patent No.: US 8,038,260 B2
(45) Date of Patent: Oct. 18, 2011

(54) PATTERN OF A NON-WETTING COATING ON A FLUID EJECTOR AND APPARATUS

(75) Inventor: Yoshimasa Okamura, San Jose, CA (US)

(73) Assignee: FUJIFILM Dimatix, Inc., Lebanon, NH (US)

( * ) Notice: Subject to any disclaimer, the term of this patent is extended or adjusted under 35 U.S.C. 154(b) by 971 days.

(21) Appl. No.: 11/959,362

(22) Filed: Dec. 18, 2007

(65) Prior Publication Data

US 2008/0150998 A1 Jun. 26, 2008

Related U.S. Application Data

(60) Provisional application No. 60/871,646, filed on Dec. 22, 2006.

(51) Int. Cl.
*B41J 2/135* (2006.01)

(52) U.S. Cl. ..... 347/45; 347/47

(58) Field of Classification Search ..... 347/40, 347/45–47

See application file for complete search history.

(56) References Cited

U.S. PATENT DOCUMENTS

| | | | | |
|---|---|---|---|---|
| 5,949,454 | A | 9/1999 | Nozawa et al. | |
| 6,547,369 | B1 | 4/2003 | Temple | |
| 7,449,283 | B2 * | 11/2008 | Nishi et al. | 430/320 |
| 2001/0043250 | A1 | 11/2001 | Faisst, Jr. et al. | |
| 2004/0104959 | A1 | 6/2004 | Brown et al. | |

* cited by examiner

*Primary Examiner* — Thinh Nguyen
(74) *Attorney, Agent, or Firm* — Fish & Richardson P.C.

(57) ABSTRACT

A fluid ejector is provided, having an internal surface, an external surface, an orifice that allows fluid in contact with the internal surface to be ejected, a first non-wetting region of the external surface, and one or more second regions of the external surface that are more wetting than the first non-wetting region. A process for cleaning the fluid ejectors is provided that includes detachably securing a faceplate to the fluid ejector and moving a wiper laterally across the faceplate.

16 Claims, 5 Drawing Sheets

FIG. 6
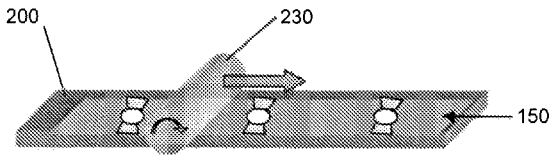
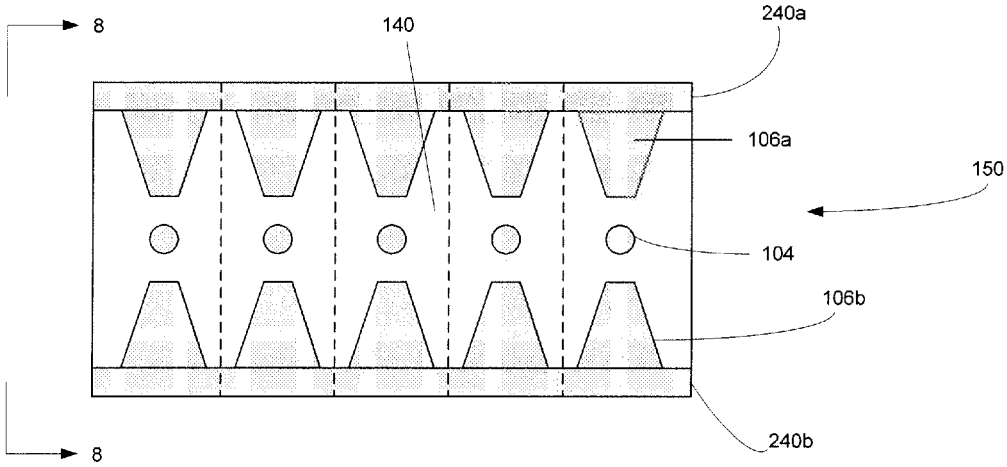
FIG. 7
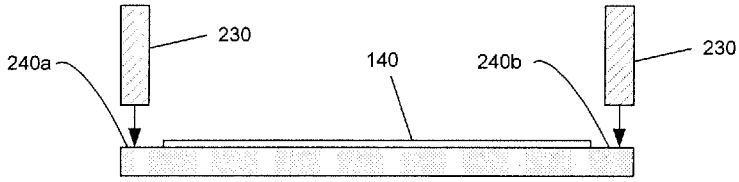
FIG. 8

PATTERN OF A NON-WETTING COATING ON A FLUID EJECTOR AND APPARATUS

CROSS-REFERENCE TO RELATED APPLICATIONS

This application claims priority to U.S. Provisional Application Ser. No. 60/871,646, filed on Dec. 22, 2006.

TECHNICAL FIELD

This invention relates to coatings on fluid ejectors, an apparatus for cleaning an exterior surface of a fluid ejector, and related methods.

BACKGROUND

A fluid ejector (e.g., an inkjet printhead) typically has an interior surface, an orifice through which fluid is ejected, and an exterior surface. When fluid is ejected from the orifice, the fluid can accumulate on the exterior surface of the fluid ejector. When fluid accumulates on the exterior surface adjacent to the orifice, further fluid ejected from the orifice can be diverted from an intended path of travel or blocked entirely by interaction with the accumulated fluid (e.g., due to surface tension).

Non-wetting coatings such as Teflon® and fluorocarbon polymers can be used to coat surfaces. However, Teflon® and fluorocarbon polymers typically are soft and are not durable coatings. These coatings also can be expensive and difficult to pattern.

SUMMARY

The disclosure features a fluid ejector having an internal surface, an external surface, an orifice that allows fluid in contact with the internal surface to be ejected, a first non-wetting region of the external surface, and one or more second regions of the external surface that are more wetting than the first non-wetting regions.

Implementations may include one or more of the following features. The first non-wetting region may be adjacent to and completely surround the orifice. The second regions may have one or more portions that are proximal to the orifice and one or more portions that are distal to the orifice. The second regions may have an increasing lateral dimension as distance from the orifice increases. The non-wetting region may be formed from a polymer or a monomer. The polymer may be a fluorocarbon polymer, and the monomer can be a silicon-based monomer. The silicon-based monomer may contain one or more fluorine atoms. The non-wetting region may be formed from a layer of gold onto which an alkanethiol monomer is adsorbed. The second regions may be formed from silicon, silicon oxide, or silicon nitride. The fluid ejector may have a plurality of orifices, and each orifice may be in a common plane. The orifices may be disposed with a spatial periodicity, and the first non-wetting region may be deposited in a pattern, the pattern comprising a unit cell replicated with the same spatial periodicity as the orifices.

The disclosure also features a method of cleaning one or more fluid ejectors. In certain implementations, the method includes detachably securing a faceplate to the fluid ejector and moving a wiper laterally across the faceplate. The wiper may not directly contact the fluid ejector. The wiper may be a blade, brush, or sponge. In alternative implementations, a stream of gas, e.g., air, may be applied to the exterior surface.

In yet another implementation, vacuum suction may be applied to the exterior surface.

Certain implementations may have one of more of the following advantages. Fluid may be removed from regions immediately surrounding the orifice, resulting in more stable discharges of ejected fluids. Cleaning steps may be eliminated or may be performed fewer times on coated fluid ejectors than on uncoated fluid ejectors, resulting in increased fluid ejector lifetimes and faster printing rates. Contact between the wiper and the surface of the fluid ejector may be eliminated, reducing wear on the exterior surface and increasing fluid ejector lifetimes. A wiping unit may not be necessary, allowing smaller units to be fabricated and decreasing the unit cost of manufacturing.

DESCRIPTION OF DRAWINGS

FIG. 6 is a perspective view of an implementation of an array of fluid ejectors with an attached faceplate in which a wiper is rolled across the faceplate.

FIG. 7 is a top view of a fluid ejector with another implementation of a patterned non-wetting layers deposited on portions of the exterior surface.

FIG. 8 is an end view of a fluid ejector having two rollers to remove fluid from uncoated regions of the exterior surface.

Like reference symbols in the various drawings indicate like elements.

DETAILED DESCRIPTION

Figure 1A:
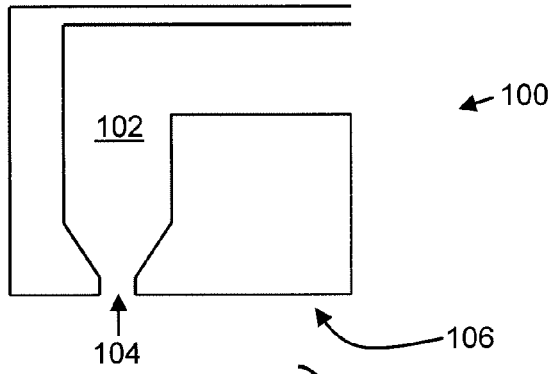
FIG. 1A is a cross-sectional view of an implementation of an uncoated fluid ejector.

FIG. 1A is a cross-sectional view of an uncoated fluid ejector 100 (e.g., an ink-jet printhead nozzle), which can be constructed as described in U.S. patent application Ser. No. 11/256,669, filed Oct. 21, 2005, the contents of which are hereby incorporated by reference. The fluid flows through a descender 102 and is ejected through an orifice 104. Fluid ejector 100 also includes an exterior surface 106. Exterior surface 106 may be a native silicon surface, a deposited oxide surface, e.g. silicon dioxide, or another material such as silicon nitride.

Figure 1B:
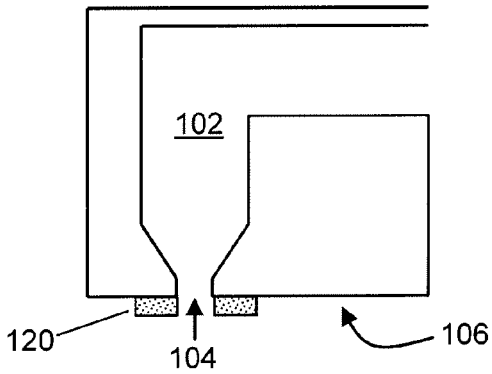
FIG. 1B is a cross-sectional view of an implementation of the fluid ejector from FIG. 1A with a patterned non-wetting layer deposited on an exterior surface.

Referring to FIG. 1B, a non-wetting coating 120 has been deposited on portions of exterior surface 106. The non-wetting coating 120 can be hydrophobic material. The region that is not coated, e.g., the uncoated exterior surface, is more wettable (e.g., has a smaller contact angle) than the non-wetting coating 120.

Non-wetting coating 120 may be composed of Teflon®, (tridecafluoro-1,1,2,2-tetrahydrooctyl)trichlorosilane (FOTS), 1H,1H,2H,2H-perfluorodecyltrichlorosilane (FDTS), other silicon-based monomers or fluorocarbon polymers, or similar materials. These coatings may be deposited by spin coating, spray or dip coating, molecular vapor deposition (MVD®) or other suitable methods. For some materials, patterning of the non-wetting coating can be accomplished using masking processes, e.g. depositing and patterning a photoresist layer to provide a protective mask layer over those portions of the surface which are to remain free of the non-wetting coating, depositing the non-wetting coating, and then dissolving or lifting off the photoresist layer leaving the patterned non-wetting coating on the exterior surface 106. Alternatively, for some materials, patterning of the non-wetting coating can be accomplished using photolithography processes, e.g., depositing the non-wetting coating, depositing and patterning a photoresist layer to provide a protective mask layer over those portions of the surface which are to have the non-wetting coating, removing the portions of the non-wetting coating that are not covered by the photoresist (e.g., by etching), and then optionally removing the photoresist layer. To eliminate the steps of masking and removing the mask, the non-wetting coating can be patterned using laser ablation.

Figure 1C:
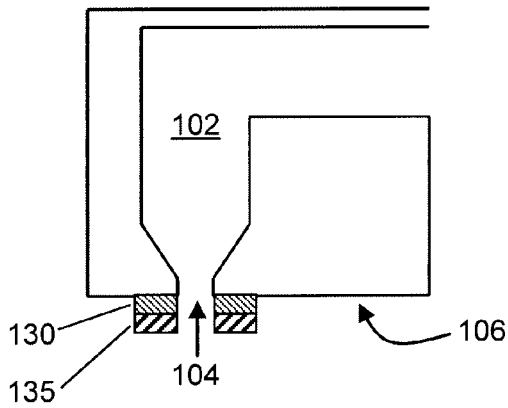
FIG. 1C is a cross-sectional view of an implementation of the fluid ejector from FIG. 1A with a patterned non-wetting coating on an exterior surface, wherein the non-wetting layer comprises an intermediate gold layer and an outer alkanethiol monolayer.

FIG. 1C represents an alternative method of depositing a non-wetting coating. A layer 130 of gold, is first deposited on a portion of exterior surface 106. An alkanethiol layer 135 is then deposited on the gold layer, forming a monolayer. The formation and selective deposition of alkanethiol monolayers on gold can be performed using conventional techniques. Alkanethiol monolayers may be wetting or non-setting. Suitable non-wetting alkanethiols include, by way of example, octadecylthiol and 1H,1H,2H,2H-perfluorodecanethiol. Selective deposition of gold (typically between a thickness of about 50 nm to about 200 nm) may be accomplished using conventional photolithography and evaporation techniques.

Figure 2A:
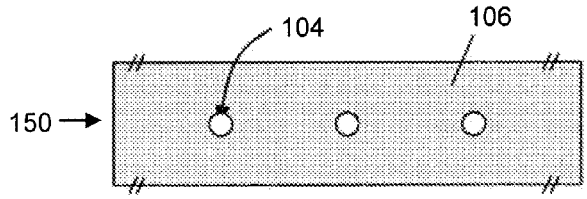
FIG. 2A is a top view of an exterior surface of an implementation of an uncoated fluid ejector.

FIG. 2A-E illustrate a portion of an array 150 of orifices in a fluid ejector. FIG. 2A shows an uncoated exterior surface 106 with three orifices 104, although the fluid ejector may have just one or two orifices, or more than three orifices, e.g. more than 20, e.g. more than 100. The orifices can arranged in an array, e.g., a single row with regular spacing, or multiple rows with regular spacing (in which case the rows can be offset relative to each other).

FIGS. 2B-E illustrate alternative implementations of a portion of a fluid ejector with an array 150 of orifices in which non-wetting coating 140 and uncoated regions form various patterns. In these implementations, non-wetting coating 140 is deposited in an area that is adjacent to and completely surrounds orifice 104. In general, the non-wetting coating is patterned to provide one or more areas without the non-wetting coating that form elongated regions extending away from the orifice.

Figure 2B:
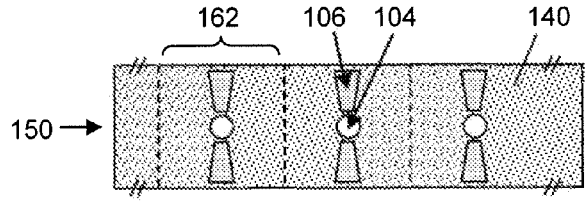
FIGS. 2B-E are top views of implementations of the fluid ejector from FIG. 2A with patterned non-wetting layers deposited on portions of the exterior surface.

FIG. 2B illustrates an implementation of a fluid ejectors of FIG. 2A which has been coated with a patterned non-wetting coating 140. The resulting pattern can be described as a series of unit cells 162, each unit cell defined by a central orifice 104 and two uncoated regions 106, each such region appearing as a trapezoid. In this implementation, each trapezoid comprises one end which is proximal to the orifice, and one end which is distal to the orifice, the distal end being wider than the proximal end. The unit cell has mirror symmetry defined by a plane that is perpendicular to the plane of the array and that bisects the orifices. The unit cell may be replicated along array 150 to produce a pattern with a periodicity equal to that of the orifices.

Figure 2C:
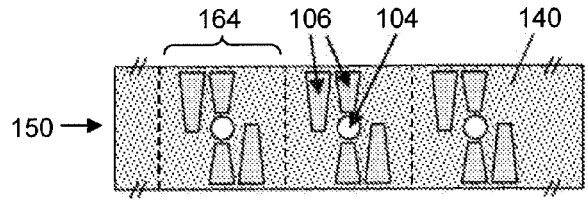

FIG. 2C shows an alternative implementation to that depicted in FIG. 2B. In this implementation, each unit cell 164 contains a central orifice and four trapezoidal regions. Two trapezoidal regions are those depicted in FIG. 2B while the other two trapezoidal regions are displaced laterally. As in FIG. 2B, each trapezoid comprises one end which is proximal to the orifice, and one end which is distal to the orifice, the distal end being wider than the proximal end. The unit cell has rotational symmetry about a line through the center of the orifice and perpendicular to the plane of the array. The unit cell may be replicated along array 150 to produce a pattern with a periodicity equal to that of the orifices.

Figure 2D:
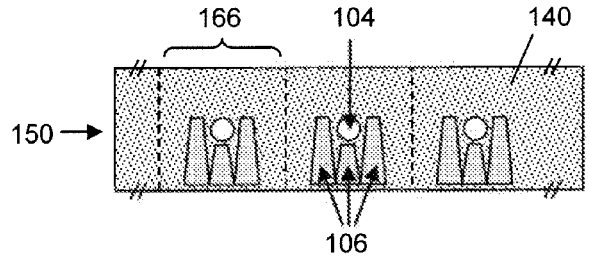

FIG. 2D shows another implantation of a patterned array. In this implementation, each unit cell 166 contains a central orifice and three trapezoidal regions. As in the examples illustrated by FIGS. 2B-C, each trapezoid comprises one end which is proximal to the orifice, and one end which is distal to the orifice, the distal end being wider than the proximal end. The unit cell has mirror symmetry defined by a plane that is perpendicular to both the line that passes through the center of the orifices and to the plane of the array. The unit cell may be replicated along array 150 to produce a pattern with a periodicity equal to that of the orifices.

Figure 2E:
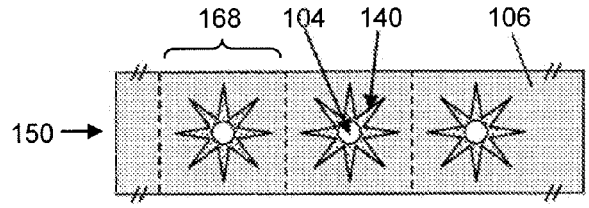

FIG. 2E illustrates yet another implantation of a patterned array. In contrast to the implementations depicted in FIGS. 2B-D, in which a majority of the surfaces are coated with non-wetting coating 140 and the non-wetting coating forms a generally continuous layer on the fluid ejector, in the implementation illustrated in FIG. 2E, a relatively small region of the array is coated with non-wetting coating 140 and the regions of non-wetting coating around each orifice are unconnected. In this implementation, each unit cell 168 can be described as non-wetting coating 140 in a star shape surrounding central orifice 104 and sharing a rotational symmetry axis with the orifice. As depicted in FIG. 2E, the star has eight points. This geometry is exemplary however, and patterns in alternative implementations may take other forms. As in the other implementation, unit cell 168 may be replicated along array 150 to produce a pattern with a periodicity equal to that of the orifices.

Referring again to FIGS. 2B-2E, non-wetting coating 140 may be, as described above, either a polymer or a monomer coating e.g. a fluorocarbon polymer or silicon-based monomer, or an alkanethiol monomer deposited on an underlying gold layer. The uncoated exterior surface regions 106 will be more wetting than regions coated with non-wetting coating 140. Without being bound to any particular theory, fluid ejected from orifices may adhere to the external surface of the array. Such adhered fluid may adhere preferentially to uncoated exterior surface regions 106, and may be repelled from regions coated with non-wetting coating 140. Thus, various patterns of coated and uncoated regions may provide a passive transport mechanism to wick or draw adhered fluid droplets away from fluid ejector orifices.

Figure 3A:
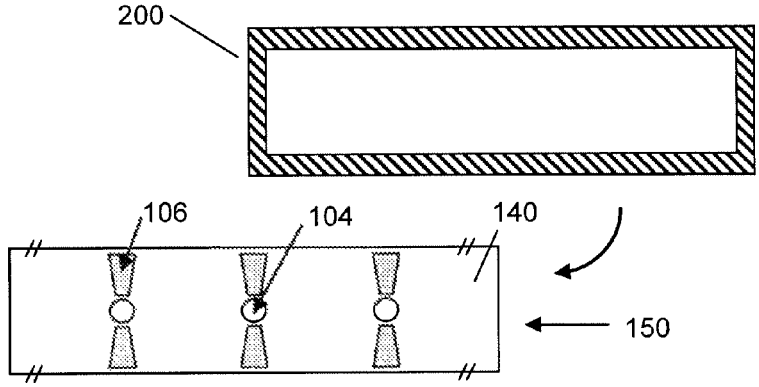
FIG. 3A is a view of an implementation of an array of fluid ejectors and an unattached faceplate.
Figure 3B:
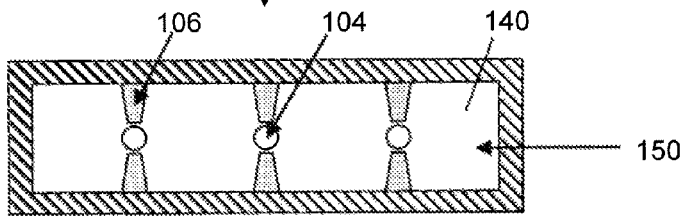
FIG. 3B is a view of the implementation of FIG. 3A with the faceplate attached to the exterior surface of the fluid ejector array.

Referring to FIG. 3A, a portion of a fluid ejector is shown with a faceplate 200 unattached. FIG. 3B shows faceplate 200 detachably secured to the fluid ejector. Faceplate 200 contacts only the outer edges of the fluid ejector, leaving a substantial portion of the outer surface exposed. Faceplate 200 may be formed from suitable polymer, typically a polymer that is flexible and non-abrasive. Faceplate 200 may be detachably secured to array 150 during, e.g., a cleaning step.

Figure 4A:
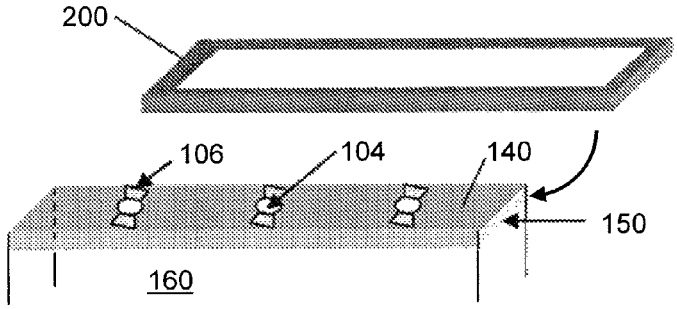
FIGS. 4A-B are perspective views of the implementations in FIGS. 3A-B, respectively.
Figure 4B:
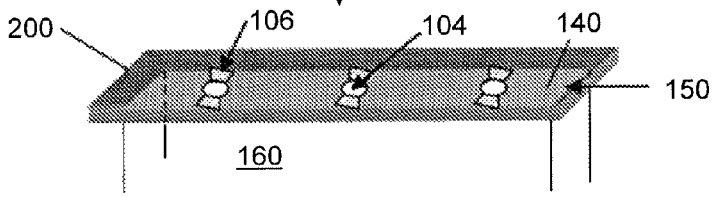

FIGS. 4A and 4B show in perspective view a portion of an array 150 of fluid ejectors with faceplate 200 unattached (FIG. 4A), and attached to outer edges of the array. (FIG. 4B). Region 160 represents the remainder of the fluid ejector apparatus, not shown.

Figure 5A:
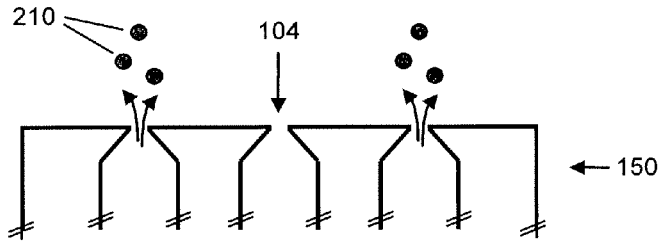
FIG. 5A is a cross-sectional view of an implementation of a fluid ejector array in which fluid is being ejected from some of the fluid ejectors.
Figure 5B:
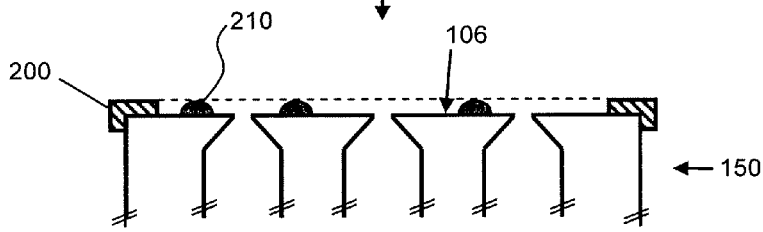
FIG. 5B is a cross-sectional view of an implementation of a fluid ejector array from FIG. 5A with an attached faceplate, and in which droplets of fluid are adhered to portions of the exterior surface.

FIGS. 5A-D illustrate process steps of an array of fluid ejectors in use and during a cleaning step. FIG. 5A shows a cross-sectional view of an array 150 of three fluid ejectors in operation: two fluid ejectors are ejecting, through orifice 104, fluid (e.g. an ink) depicted in this example in the form of droplets 210; one of the fluid ejectors is not ejecting fluid. Referring to FIG. 5B, some time after fluid is ejected, droplets 210 may adhere to uncoated portions 106 of the array surface. In keeping with the theory outlined above, droplets may preferentially adhere to uncoated regions, however droplets may also adhere to regions coated with a non-wetting coating.

Figure 5C:
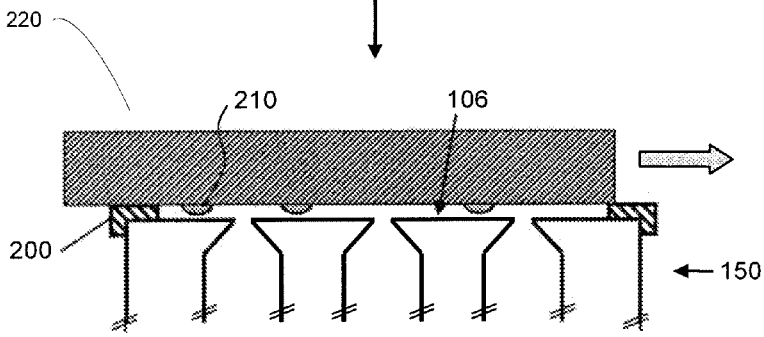
FIG. 5C is a cross-sectional view of an implementation in FIG. 5B in which a wiper removes adhered fluid droplets from the exterior surface.
Figure 5D:
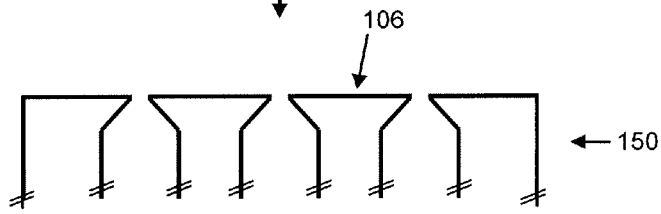
FIG. 5D is a cross-sectional view of an implementation of FIG. 5C in which the exterior surface has been cleaned from adhered fluid droplets, and the faceplate has been removed.

FIG. 5B also shows faceplate 200 attached to array 150, contacting only portions of the outer edges of the array. FIG. 5C illustrates a wiper 220 moving laterally across the outer surface of faceplate 200. Wiper 220 contacts faceplate 200 but does not directly contact array 150. That is, the thickness of faceplate 200 may be chosen, and the faceplate may be connected to the array 150, so that the faceplate 200 projects slightly above the external surface 106 of the array, e.g., by less than the diameter of a typical drop of fluid that would be ejected from the array, e.g., by 50 microns or less. Thus, the faceplate 200 acts as a stop so that wiper 220 contacts adhered droplets 210 and removes them from the array surface without directly contacting the array surface. Wiper 220 may be formed of a material which tends to absorb fluids, e.g. ink, ejected from the fluid ejectors. Referring to FIG. 5D, after moving wiper 220 across faceplate 200, the faceplate may then be removed to reveal a clean external surface of array 150, that is, an external surface with either no adhered droplets, or a reduced volume of adsorbed fluid than before the cleaning step. In certain implementations, other forms of a wiper may be used, e.g. a blade, sponge, brush, roller, or similar device. In other implementations, a blast of air, other gas, or suction may be used to remove adhered droplets from the array.

FIG. 6 shows a perspective view of an implementation of array 150 with attached faceplate 200, across which a wiper, here in the form of a roller 230, is rolled. The array 150 includes regions coated with a non-wetting coating and uncoated regions to move fluid away from the nozzles, and the roller removes the fluid.

FIG. 7 shows a top view of another implementation of a fluid ejector 150 which has been coated with a patterned non-wetting coating 140. This implementation is similar to FIG. 2B, with uncoated regions 106*a*, 106*b*, e.g., trapezoidal regions, extending away from the nozzles 104. However, in this implementation, the uncoated regions 106*a* on one side of the line of nozzles are connected to a common uncoated region 240*a* that can extend along and in parallel to the entire line of nozzles. Similarly, the uncoated regions 106*b* on the other side of the line of nozzles are connected to a common uncoated region 240*b* that can extend along and in parallel to the entire line of nozzles. The uncoated regions 240*a*, 240*b* can join to the wider end of the trapezoidal regions 106*a*, 106*b*, respectively. The uncoated regions 240*a*, 240*b* can be at the edges of the substrate.

Although FIG. 7 is similar to FIG. 2B, the uncoated regions extending along and in parallel to the line of nozzles could be used with other implementations, e.g., with the patterns illustrated in FIGS. 2C and 2D (in the implementation of FIG. 2D, the uncoated region could extend only along one side of the line of nozzles).

Referring to FIG. 8, a wiper, e.g., a roller 230, can be positioned to directly contact an uncoated region (and not contact the coated region) of the external surface that extends parallel to the line of nozzles. The roller 230 can be configured to move parallel to the line of nozzles, removing the fluid that has been wicked from the coated surface 140. In some implementation, illustrated in FIG. 8, two wipers, e.g., rollers 230 are arranged in parallel to simultaneously directly contact the uncoated regions 240*a*, 240*b* on opposite sides of the line of nozzles so as to remove the fluid. In the implementations in which the wiper directly contacts the uncoated region of the printhead 150, the faceplate 200 (not shown) need not project above the surface of the module. For example, the outer surface of the faceplate could be flush, or below the surface of the module, or the faceplate might be omitted entirely.

A number of embodiments of the invention have been described. Nevertheless, it will be understood that various modifications may be made without departing from the spirit and scope of the invention. For example, additional patterns of non-wetting coating and uncoated regions may be envisaged, and method steps may be performed in a different order than herein depicted, and the desired results may still be produced. Accordingly, other embodiments are within the scope of the following claims.

What is claimed is:

1. A fluid ejector comprising:

an internal surface;

an external surface;

an orifice that allows fluid in contact with the internal surface to be ejected;

a first non-wetting region of the external surface; and one or more second regions of the external surface, the second regions being more wetting than the first non-wetting region, wherein the second regions of the external surface comprise one or more portions that are proximal to the orifice and one or more portions that are distal to the orifice, and wherein the second regions of the external surface further comprise an increasing lateral dimension as distance from the orifice increases.

2. The fluid ejector of claim 1 wherein the first non-wetting region is adjacent to and completely surrounds the orifice.

3. The fluid ejector of claim 1 wherein the first non-wetting region is formed from a polymer.

4. The fluid ejector of claim 3 wherein the polymer is a fluorocarbon polymer.

5. The fluid ejector of claim 1, wherein the first non-wetting region comprises a silicon-based monomer.

6. The fluid ejector of claim 5 wherein the silicon-based monomer contains one or more fluorine atoms.

7. The fluid ejector of claim 1 wherein the first non-wetting region is formed from a layer of gold onto which an alkanethiol monomer is adsorbed.

8. The fluid ejector of claim 1 wherein the second regions are formed from silicon, silicon oxide, or silicon nitride.

9. The fluid ejector of claim 1 comprising a plurality of orifices, each orifice in a common plane.

10. The fluid ejector of claim 9 wherein the plurality of orifices appears with a spatial periodicity, and wherein the first non-wetting region is deposited in a pattern, said pattern comprising a unit cell replicated with the same spatial periodicity as the orifices.

11. A method of cleaning a fluid ejector comprising:

detachably securing a faceplate to a fluid ejector according to claim 1; and moving a wiper laterally across the faceplate.

12. The method of claim 11 wherein the wiper does not directly contact the fluid ejector.

13. The method of claim 11 wherein the wiper is a blade, brush, roller, or sponge.

14. A method of cleaning a fluid ejector comprising:

applying a stream of gas to the exterior surface of a fluid ejector according to claim 1.

15. The method of claim 14, wherein the gas is air.

16. A method of cleaning a fluid ejector comprising:

applying vacuum suction to the exterior surface of a fluid ejector according to claim 1.

* * * * *